US009182118B2

(12) United States Patent
Akagi et al.

(10) Patent No.: US 9,182,118 B2
(45) Date of Patent: Nov. 10, 2015

(54) COMBUSTION PLATE

(75) Inventors: Kazuyuki Akagi, Aichi (JP); Masaru Takeuchi, Aichi (JP)

(73) Assignee: RINNAI CORPORATION, Aichi (JP)

( * ) Notice: Subject to any disclaimer, the term of this patent is extended or adjusted under 35 U.S.C. 154(b) by 322 days.

(21) Appl. No.: 13/985,401

(22) PCT Filed: Feb. 29, 2012

(86) PCT No.: PCT/JP2012/001379

§ 371 (c)(1),
(2), (4) Date: Aug. 14, 2013

(87) PCT Pub. No.: WO2012/117726

PCT Pub. Date: Sep. 7, 2012

(65) Prior Publication Data

US 2013/0337390 A1 Dec. 19, 2013

(30) Foreign Application Priority Data

Mar. 2, 2011 (JP) ..... 2011-044826

(51) Int. Cl.
*F23D 14/14* (2006.01)
*F23D 14/58* (2006.01)
*F23D 14/02* (2006.01)

(52) U.S. Cl.
CPC ..... *F23D 14/14* (2013.01); *F23D 14/58* (2013.01); *F23D 2203/1023* (2013.01); *F23D 2209/20* (2013.01); *F23D 2212/10* (2013.01); *F23D 2900/00003* (2013.01)

(58) Field of Classification Search
CPC ..... F23D 14/02
USPC ..... 431/328, 329, 347; 126/608
See application file for complete search history.

(56) References Cited

U.S. PATENT DOCUMENTS 7,717,704 B2 * 5/2010 Burtea et al. ..... 431/326
8,827,693 B2 * 9/2014 Akagi ..... 431/326
2013/0280662 A1 * 10/2013 Dreizler et al. ..... 431/12

FOREIGN PATENT DOCUMENTS

JP 2-7428 U 1/1990
JP 06-147435 A 5/1994

(Continued)

OTHER PUBLICATIONS

JP 07-119935A, Mura Co Ltd, Premixing Burner, May 1995, English M/C translation.*

(Continued)

*Primary Examiner* — Gregory Huson
*Assistant Examiner* — Nikhil Mashruwla
(74) *Attorney, Agent, or Firm* — Cermak Nakajima & McGowan LLP; Tomoko Nakajima

(57) ABSTRACT

A combustion plate for use in a totally aerated combustion burner has a ceramic plate body with a multiplicity of flame holes formed therein for ejecting a premixed gas. The plate body is provided, in a lattice shape, with non-flame-hole portions having no flame holes therein. Each of such regions of the plate body as are enclosed by the non-flame-hole portions constitutes a collective flame-hole portion having formed therein a plurality of flame holes. It is so arranged that flame lifting can be effectively prevented in the flame holes on the periphery of the collective flame-hole portions. Along each of such sides of the non-flame-hole portions as are adjacent to each of the collective flame-hole portions, outside flame holes are formed at a predetermined spacing therebetween in a longitudinal direction of the non-flame-hole portions. This predetermined spacing is greater than a spacing, in the longitudinal direction of the non-flame-hole portion.

3 Claims, 4 Drawing Sheets

(56) References Cited

FOREIGN PATENT DOCUMENTS

| | | | | | |
|---|---|---|---|---|---|
| JP | 06147435 | A | * | 5/1994 | ..... F23D 14/16 |
| JP | 07-119935 | A | | 5/1995 | |
| JP | 08285238 | A | * | 11/1996 | ..... F23D 14/14 |
| JP | 11-351522 | A | | 12/1999 | |
| JP | 11-351522 | A | * | 12/1999 | ..... F23D 14/14 |
| JP | 2004-324910 | A | | 11/2004 | |
| JP | 2009103407 | A | * | 5/2009 | ..... F23D 14/02 |
| JP | 2009250563 | A | * | 10/2009 | ..... F23D 14/14 |
| JP | 2011099646 | A | * | 5/2011 | ..... F23D 14/02 |

OTHER PUBLICATIONS

JP 06-14735A, Mura Co Ltd, May 1994, Surface Combustion Burner, English M/C translation.*

International Search Report for PCT Patent App. No. PCT/JP2012/001379 (Mar. 27, 2012).

* cited by examiner

COMBUSTION PLATE

This application is a national phase entry under 35 U.S.C. §371 of PCT Patent Application No. PCT/JP2012/001379, filed on Feb. 29, 2012, which claims priority under 35 U.S.C. §119 to Japanese Patent Application No. 2011-044826, filed Mar. 2, 2011, both of which are incorporated by reference.

BACKGROUND OF THE INVENTION

1. Field of the Invention

The present invention relates to a combustion plate for use in a totally aerated combustion burner (or a fully primary aerated burner) which is disposed in a heat source equipment mainly for supplying hot water or for heating a residential space, in which a ceramic plate body has formed therein a multiplicity of flame holes (burner holes) so as to eject a premixed gas.

2. Description of the Related Art

As this kind of combustion plate, there is known one in which non-flame-hole portions (i.e., portions having no flame holes) are formed on the plate body in a lattice shape, and in which each of the regions of the plate body enclosed by the non-flame-hole portions is made to be a collective flame-hole portion having formed therein in a crowded manner a plurality of flame holes (see, for example, Patent Document 1). According to this arrangement, the premixed gases that are ejected through flame holes on the periphery of the collective flame-hole portions adjacent to the non-flame-hole portions partly recirculate in a manner to swirl above the non-flame-hole portions. Then, the premixed gases that recirculate back from the flame holes on the periphery of the collective flame-hole portions that are positioned on both sides of the non-flame-hole portions interfere with each other. As a result, there will be formed, above the non-flame-hole portions, stable flames that are hard to be lifted off, thereby obtaining flame holding (stabilizing) effect.

Conventionally, a plurality of flame holes on the periphery of one of the collective flame-hole portions and a plurality of flame holes on the periphery of the other of the collective flame-hole portions lie face to face to each other along both sides, in the width direction, of the non-flame-hole portions, each of the flame holes on the respective periphery forming a pair. In this arrangement, the premixed gas that recirculates from the flame hole that makes one of the pair will get interfered with the premixed gas that recirculates from the other of the pair, above the non-flame-hole portions.

However, according to this arrangement, the following has been found out, i.e., if flame lifting occurs at part of the flame holes on the periphery of the collective flame-hole portions, starting with that point as an origin, the flames from the other flame holes on the periphery of the collective flame portions are likely to be lifted. In particular, in case the excess air ratio (amount of primary air/stoichiometric air amount) of the premixed gas is made higher, flame lifting is likely to occur in the flame holes on the periphery of the collective flame-hole portions. Caused by the above occurrence, there is a case in which flame lifting occurs in the entire collective flame-hole portions.

PRIOR ART PUBLICATION

Patent Document

Patent Document: JP-1999-351522 A

SUMMARY

Problems That the Invention is to Solve

In view of the above points, it is an object of the invention to provide a combustion plate that is capable of effectively preventing the flame lifting in the flame holes on the periphery of the collective flame-hole portions even though the excess air ratio of the premixed gas is made high.

Means for Solving the Problems

In order to solve the above-mentioned problems, the invention is a combustion plate for use in a totally aerated combustion burner in which a ceramic plate body has formed therein a multiplicity of flame holes for ejecting a premixed gas, wherein the plate body is provided, in a lattice shape, with non-flame-hole portions having no flame holes therein, each of such regions of the plate body as are enclosed by the non-flame-hole portions constituting a collective flame-hole portion having formed therein a plurality of flame holes, characterized in that, along each of such sides of the non-flame-hole portions as are adjacent to each of the collective flame-hole portions, flame holes are formed at a predetermined spacing therebetween in a longitudinal direction of the non-flame-hole portions, the predetermined spacing being set to be greater than a spacing, in the longitudinal direction of the non-flame-hole portions, between adjoining flame holes formed in the collective flame-hole portions.

According to this invention, flame holes along the sides of the non-flame-hole portions (outside flame holes) are arranged to be formed at several positions along the outside of the periphery of the collective flame-hole portions. In this arrangement, with respect to the premixed gases that recirculate from the outside flame holes toward the upper part of the non-flame-hole portions, interference takes place not only with the premixed gases that recirculate from the flame holes on the periphery of the collective flame-hole portions positioned on the other side across the non-flame-hole portions, toward the upper part of the non-flame-hole portions, but also with the premixed gases that recirculate from those flame holes on the periphery of the collective flame-hole portions which are positioned on the same side as the outside flame holes. Flame holding effect of the outside flame holes can thus be improved. Therefore, even though flame lifting takes place partly in the flame holes on the periphery of the collective flame-hole portions, flame lifting can be prevented, due to flame holding by the outside flame holes, in the flame holes on the periphery close to the outside flame holes. As a consequence, even though the excess air ratio of the premixed gas is made higher, there can be effectively prevented the occurrence of the flame lifting in the entire flame holes on the periphery and further, thanks thereto, the occurrence of the flame lifting in the entire collective flame-hole portions.

Preferably, setting is made to meet a condition $P' \geq 2P$, where P is a center distance, in the direction parallel to the longitudinal direction of the non-flame-hole portions, of flame holes formed in the collective flame-hole portions and where P' is a center distance, in the longitudinal direction of the non-flame-hole portions, of flame holes formed along each of the sides of the non-flame-hole portions. According to this arrangement, at least that one flame hole on the periphery of the collective-flame hole portions which is located on the same side as the outside flame holes will be positioned between the outside flame holes. As a result, the recirculating premixed gas from the flame hole in question will surely interfere with the recirculating premixed gases from the outside flame holes, whereby the flame holding effect of the outside flame holes can be increased.

By the way, if the outside flame holes along one width side of, and along the other width side of, the non-flame-hole portions are disposed at the same positions in the longitudinal direction of the non-flame-hole portions, the width of the non-flame-hole portions will become considerably smaller at the outside flame holes that are present on both sides thereof. The premixed gases will no longer recirculate successfully at the portions in question, whereby the flame holding effect of the outside flame holes will be lowered.

As a solution, according to this invention, preferably, outside flame holes along one width side of the non-flame-hole portions and outside flame holes along the other width side thereof are disposed at a positional shifting from each other in the longitudinal direction of the non-flame-hole portions. According to this arrangement, relative to each of the outside flame holes, the flame holes on the periphery of the collective flame-hole portions on the other side lie opposite to each other across the non-flame-hole portions. As a result, the width of the non-flame-hole portions can be prevented from getting excessively small between the outside flame holes. In addition, the premixed gases that recirculate from the outside flame holes on both sides of the non-flame-hole portions toward the upper part of the non-flame-hole portions, interfere with each other. The flame holding effect of the outside flame holes can thus be improved further.

In this case an arrangement is made such that, at a top of an isosceles triangle having a base formed by a line connecting the centers of adjoining two outside flame holes along each of the width sides of the non-flame-hole portions, there is positioned a center of an outside flame hole along the other width side of the non-flame-hole portion. Then, all of the distance (spacing) between the outside flame holes on both width sides of the non-flame-hole portions will become equal to each other. As a result, high flame holding effect can be obtained in all of the outside flame holes, whereby flame lifting can still more effectively be prevented.

PREFERRED EMBODIMENTS FOR CARRYING OUT THE INVENTION

Figure 1:
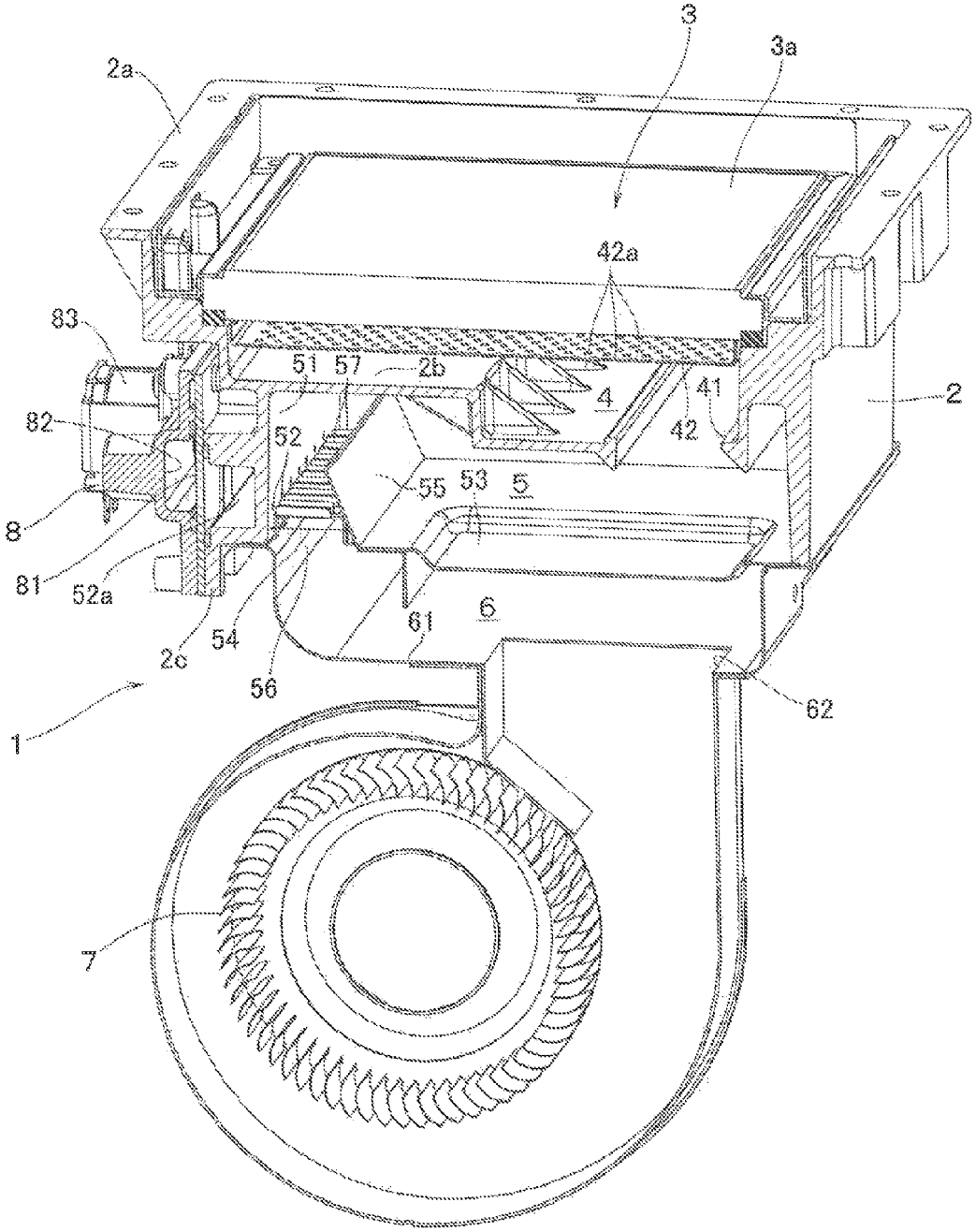
FIG. 1 is a perspective view, partly shown in section, of a totally aerated combustion burner.

With reference to FIG. 1, reference numeral 1 denotes a totally aerated combustion burner (or a fully primary aerated burner). The burner 1 has a burner main body 2 which is formed into a box shape so as to open upward, and a combustion plate 3 which is mounted on an upper part of the burner main body 2. Description will now be made in the following on condition that the width direction of the burner 1 is defined as a side (lateral) direction and the depth direction of the burner 1 is defined as a longitudinal direction.

On an outer periphery of the upper surface of the burner main body 2, there is disposed a flange portion 2*a* to which is connected a lower end of a combustion housing (not illustrated) in which are housed a heat exchanger for supplying hot water or for heating a residential space. Further, the burner main body 2 is provided therein with: a distribution chamber 4 which faces the lower surface of the combustion plate 3; and, on the lower side of the distribution chamber 4, a mixing chamber 5 which is partitioned from the distribution chamber 4 by a floor wall 2*b* which is integral with the burner main body 2. Still furthermore, an air supply chamber 6 is disposed on the lower side of the mixing chamber 5. A combustion fan 7 is connected to an air supply port 62 which is opened through a bottom surface 61 of the air supply chamber 6 so that the primary air is supplied from the combustion fan 7 to the air supply chamber 6.

At a rear part of the floor wall 2*b* which is the bottom surface of the distribution chamber 4, there is formed a laterally elongated opening portion 41 which is communicated with the mixing chamber 5. The distribution chamber 4 is partitioned into upper and lower, i.e., a total of two, spaces by a partition plate 42. It is thus so arranged that a premixed gas that flows from the mixing chamber 5 into the lower space of the distribution chamber 4 through the opening portion 41 is introduced into the combustion plate 3 through a multiplicity of distribution holes 42*a*, formed in the partition plate 42, and through the upper space of the distribution chamber 4.

The front surface 51 of the mixing chamber 5 is closed by a vertical wall 2*c* which is integral with the burner main body 2. The front surface 51 is provided with a plurality of nozzle holes 52 which are made up of holes penetrating the vertical wall 2*c* in a manner parallel with, and at a lateral spacing from, one another. Moreover, on an outer surface of the vertical wall 2*c*, there is mounted a gas manifold 8 through a partition plate 81 which defines a nozzle passage 52*a* communicating with the plurality of nozzle holes 52 between the partition plate 81 and the vertical wall 2*c*. The partition plate 81 is provided with an opening (not illustrated) which communicates a gas passage 82 inside the gas manifold 8 and the nozzle passage 52*a* together. The gas manifold 8 is provided with a solenoid valve 83 which opens and closes the above-mentioned opening. It is thus so arranged that, when the solenoid valve 83 is opened, the fuel gas is supplied to the nozzle passage 52*a* so that the fuel gas is ejected from each of the nozzle holes 52.

On the bottom surface 53 of the mixing chamber 5, there is disposed a wall plate 55 upright in a manner to lie opposite to the front surface 51 of the mixing chamber 5 while leaving (or maintaining) a ventilation clearance 54 between the front surface 51 and the wall plate 55 so that the fuel gas to be ejected from each of the nozzle holes 52 collides with the wall plate 55. The wall plate 55 is extended upward and is inclined in a forward direction. In that portion of the bottom surface 53 of the mixing chamber 5 which faces the ventilation clearance 54, there is formed a laterally elongated air inlet 56 which introduces the primary air from the air supply chamber 6 into the mixing chamber 5. It is thus so arranged that the fuel gas ejected from each of the nozzle holes 52 is diffused by colliding with the wall plate 55, that the diffused fuel gas gets mixed with the primary air that flows into the ventilation clearance 54 so as to accelerate the mixing of the fuel gas and the primary air, and consequently that a homogeneous premixed gas can be generated.

Furthermore, the ventilation clearance 54 is provided with longitudinally elongated baffle plates 57 in a trough shape so as to be positioned under each of the nozzle holes 52. According to this arrangement, even in weak combustion when the amount of ejection of the fuel gas is reduced to a small amount, the fuel gas can be collided with the wall plate 55 surely without being influenced by the primary air.

Figure 2:
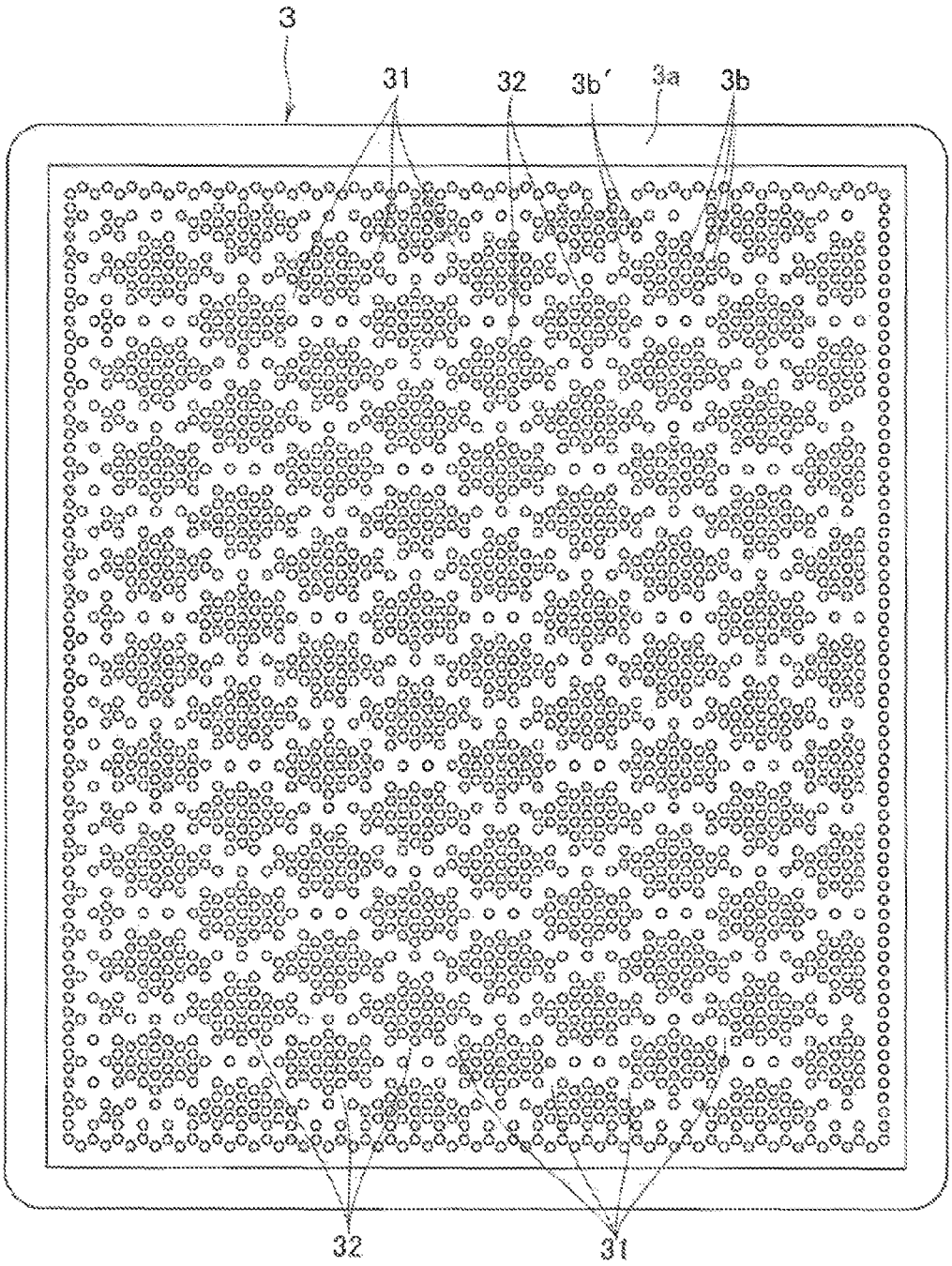
FIG. 2 is a plan view of a combustion plate according to an embodiment of this invention.

The combustion plate 3 is made up, as shown in FIG. 2, of a plate main body 3*a* of ceramic make and has formed therein a multiplicity of flame holes 3*b*. A premixed gas is ejected from these flame holes 3*b* to perform totally aerated combustion (or fully primary aerated combustion). Detailed description will now be made of the combustion plate 3. It is to be noted here that the flame holes 3*b* are omitted in FIG. 1 to simplify the figure.

In this embodiment, the plate main body 3*a* is provided, in a shape of a rhombus lattice, with non-flame-hole portions 31 in which flame holes 3*b* are not present. Those regions of the plate main body 3*a* which are enclosed by the non-flame-hole portions 31 respectively constitute collective flame-hole portions 32 in which a plurality of flame holes 3*b* are formed densely (or in a crowded manner). In concrete example with reference to FIG. 3, the length L of one side of the rhombus which circumscribes the flame holes 3*b* on the periphery of the collective flame-hole portion 32 is made to be 9 mm, and the width W of the non-flame-hole portions 31 between these rhombi is made to be 4 mm. In each of the collective flame-hole portions 32, twenty-five flame holes 3*b* in all of 1.2 mm in diameter each are formed so that the spacing (center distance) P between the adjoining flame holes 3*b* in the direction parallel to the longitudinal direction of the non-flame-hole portions 31 (i.e., in the direction parallel to each side of the rhombus) becomes 1.95 mm.

Further, along each of that side of the non-flame-hole portions 31 which lies adjacent to (or in contact with) each of the collective flame-hole portions 32, there are formed flame holes (outside flame holes) 3*b*' at a predetermined spacing (distance) from one another in the longitudinal direction of the non-flame-hole portions 31. This predetermined spacing, i.e., the longitudinal center distance P' between the adjoining outside flame holes 3*b*' in the non-flame-hole portions 31 is set to be greater than the center distance P, in the longitudinal direction of the non-flame-hole portion 31, of the flame holes 3*b* to be formed in the collective flame-hole portions 32. Preferably, P' shall be set greater than 2P. In this embodiment, an arrangement is made that P' is equal to 3P. The outside flame holes 3*b*' each has the same diameter as that of the flame holes 3*b* to be formed in the collective flame-hole portions 32.

Further, outside flame holes 3*b*' along one width side of the non-flame-hole portions 31 and outside flame holes 3*b*' along the other width side thereof are disposed at a positional shifting in the longitudinal direction of the non-flame-hole portion 31. In this embodiment, the position of the outside flame holes 3*b*' on one width side of the non-flame-hole portion 31 and the position of the outside flame holes 3*b*' on the other width side of the non-flame-hole portion 31 are shifted from each other in the longitudinal direction of the non-flame-hole portion 31 so that, at the top of an isosceles triangle T having a base formed by a line connecting the centers of adjoining two outside flame holes 3*b*', 3*b*' along each of the width sides of the non-flame-hole portions 31, there is positioned the center of an outside flame hole 3*b*' along the other width side of the non-flame-hole portions 31. According to this arrangement, all the spacing between the outside flame holes 3*b*', 3*b*' on both width sides of the non-flame-hole portion 31 becomes equal to each other.

Figure 4:
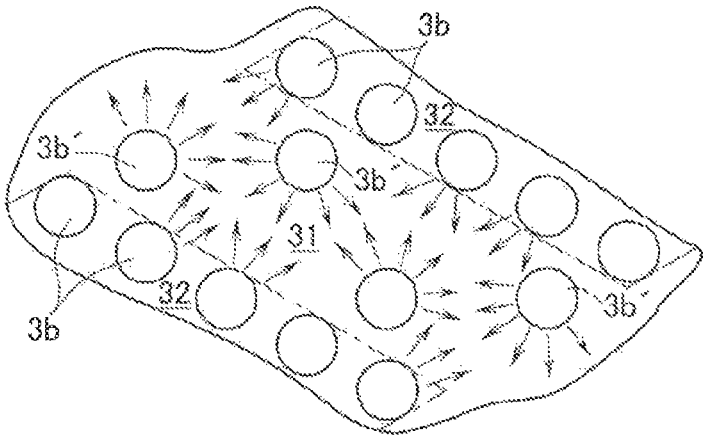
FIG. 4 is a schematic diagram showing the direction of recirculation of premixed gases toward the upper parts of non-flame-hole portions of the combustion plate according to the embodiment of this invention.

According to this embodiment, outside flame holes 3*b*' are disposed at several positions along the outside of the periphery of the collective flame-hole portions 32. As shown by arrows in FIG. 4, with respect to the premixed gases that recirculate from the outside flame holes 3*b*' toward the upper part of the non-flame-hole portions 31, interference takes place not only with the premixed gases that recirculate from the flame holes 3*b* on the periphery of the collective flame-hole portions 32 positioned on the other side across the non-flame-hole portions 31, toward the upper part of the non-flame-hole portions 31, but also with the premixed gases that recirculate from those flame holes 3*b* on the periphery of the collective flame-hole portions 32 which are positioned on the same side as the outside flame holes 3*b*'. In other words, by making the setting to meet the condition P'≥2P, at least one (two flame holes if the setting is made to be P'=3P as in the embodiment of this invention) out of the flame holes 3*b* on the periphery of the collective flame-hole portions 32 that are positioned on the same side as the outside flame holes 3*b*', 3*b*', will be positioned between the outside flame holes 3*b*', 3*b*' on each side of the non-flame-hole portions 31. In this manner, the recirculating premixed gas from the flame hole 3*b* in question will surely interfere with the recirculating premixed gas from the outside flame holes 3*b*'. As a consequence, the recirculating premixed gases will interfere with one another in as wide a range as substantially 180° of the circumference of the outside flame holes 3*b*', whereby the flame holding effect of the outside flame holes 3*b*' can be increased. Therefore, even though flame lifting occurs in part of the flame holes 3*b* on the periphery of the collective flame-hole portions 32, due to the flame holding at the outside flame holes 3*b*', flame lifting can be prevented in the flame holes 3*b* of the periphery closer to the outside flame holes 3*b*'. As a result, even though the excess air ratio of the premixed gases is made higher, there can be effectively prevented the occurrence of the flame lifting in the entire flame holes 3*b* on the periphery, as well as the occurrence of flame lifting, caused thereby, in the entire collective flame-hole portions 32.

By the way, if the outside flame holes 3*b*' along one width side of, and the outside flame holes 3*b*' along the other width side of, the non-flame-hole portions 31 are disposed at the same positions in the longitudinal direction of the non-flame-hole portions 31, the width of the non-flame-hole portions 31 will become considerably smaller at the outside flame holes 3*b*', 3*b*' that are present on both sides thereof. The premixed gases will no longer recirculate successfully at the portions in question, whereby the flame holding effect of the outside flame holes 3*b*' will be lowered.

On the other hand, according to this embodiment, outside flame holes 3*b*' along one width side of the non-flame-hole portions 31 and outside flame holes 3*b*' along the other width side of the non-flame-hole portions 31 are disposed at a positional shifting from each other in the longitudinal direction of the non-flame-hole portions 31. According to this arrangement, relative to each of the outside flame holes 3*b*', the flame holes 3*b* on the periphery of the collective flame-hole portions 32 on the other side lie opposite to each other across the non-flame-hole portions 31. As a result, the width of the non-flame-hole portions 31 can be prevented from becoming excessively narrow between the outside flame holes 3*b*', 3*b*'. In addition, the premixed gases that recirculate from the outside flame holes 3*b*', 3*b*' on both sides of the non-flame-hole portions 31 toward the upper part of the non-flame-hole portions 31, come to interfere with each other. The flame holding effect of the outside flame holes 3*b*' can thus be improved further. Particularly, in this embodiment, all the spacing becomes equal to each other between the outside flame holes 3*b*', 3*b*' on both width sides of the non-flame-hole portions 31. Therefore, there can be obtained a high flame holding effect in all of the outside flame holes 3*b*', whereby flame lifting can more effectively be prevented.

Figure 3:
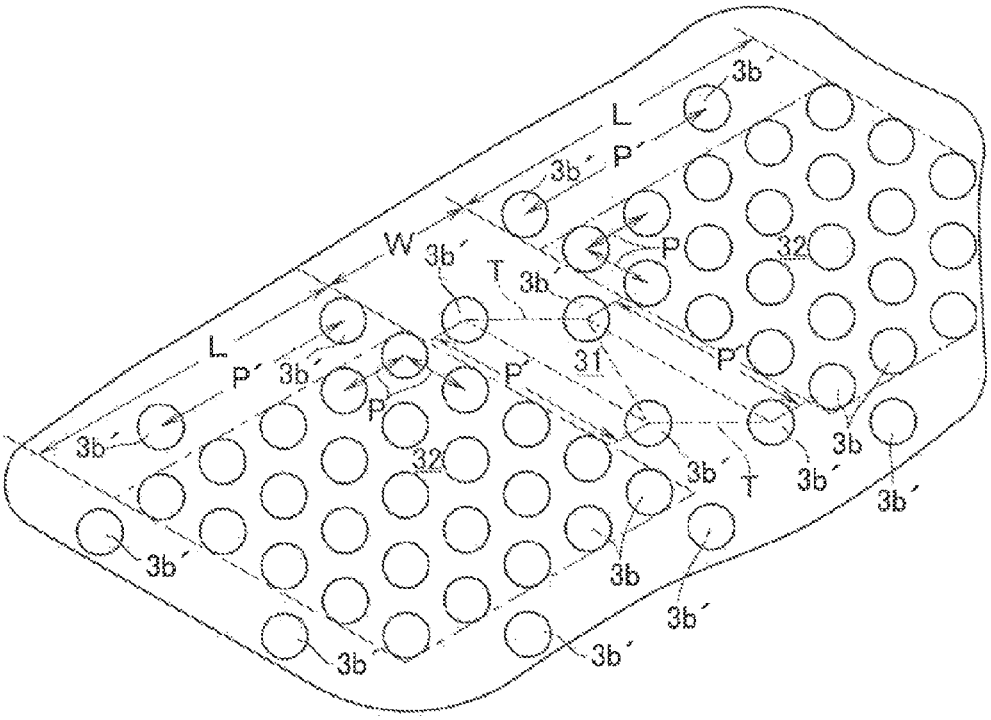
FIG. 3 is a partly enlarged plan view of the combustion plate according to the embodiment of this invention.

In order to confirm the above-mentioned effects, tests were carried out by using the combustion plate according to the embodiment (product of this invention) in which each of the dimensions L, W, P, P' in FIG. 3 was made to be the above-mentioned exemplified dimension, and a combustion plate (comparison product) each of whose dimensions of L, W, P was made to be the above-mentioned exemplified dimension but whose outside flame holes 3*b*' were omitted. The tests were carried out in a state in which the heat exchanger was disposed above the burner. In the combustion tests, the CO concentration in the combustion exhaust gases that pass through the heat exchanger was measured by varying the input (the supply amount as converted to the calorific value of the fuel gas) while the amount of the primary air was kept constant. The amount of the primary air was set so that the excess air ratio becomes 1.3 at the time of input of 10 kW.

Figure 5:
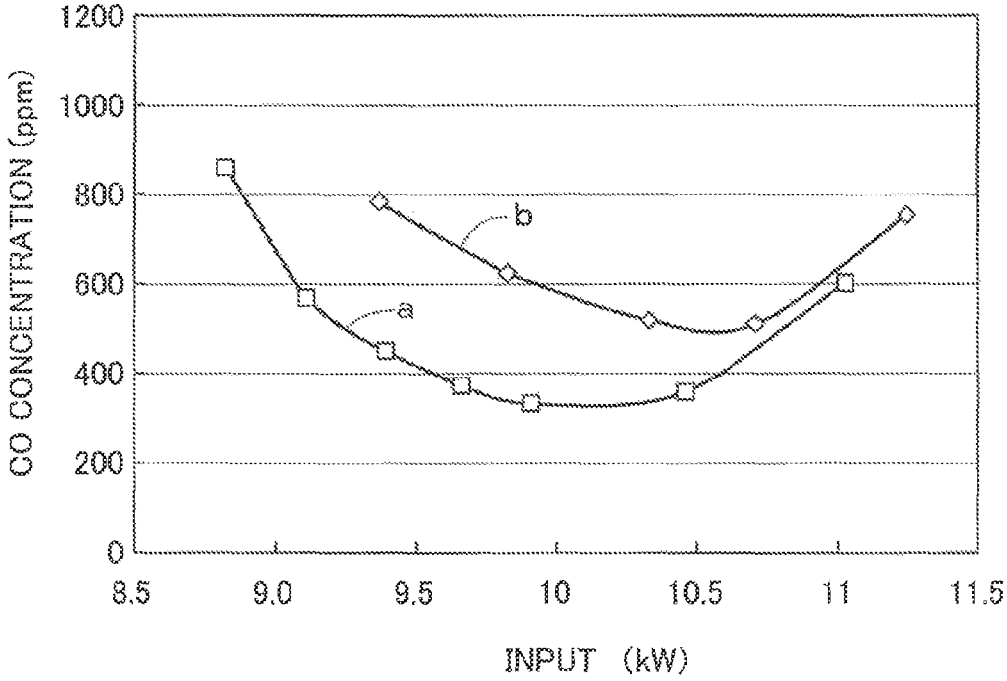
FIG. 5 is a graph showing combustion test results using the product of this invention and a comparison product.

According to the product of this invention, the CO concentration varied with the change in input as shown in curve "a" in FIG. 5, and that of the comparison product varied as shown in curve b in FIG. 5. When the excess air ratio of the premixed gas was lowered by an increase in the input, complete mixing of the fuel gas and the primary air is difficult. As a consequence, the excess air ratio in the ejected gas from the combustion plate becomes partly below 1, resulting in incomplete combustion accompanied by an increase in CO concentration. Further, when the excess air ratio in the premixed gas was increased by decreasing the input, flame lifting was likely to occur. As a result, the CO concentration increased as a result of contact of the flames with the heat exchanger before the flames finish the combustion reaction. As can be seen from FIG. 5, when the input was increased (the excess air ratio was decreased), there was no remarkable difference in CO concentration between the product of this invention and the comparison product. However, when the input was decreased (the excess air ratio was increased), the CO concentration of the product of this invention was largely decreased as compared with the comparison product. It can be seen from this fact that, by providing the combustion plate with the outside flame holes 3*b*', the flame lifting can be effectively prevented even in case the excess air ratio in the premixed gases is high.

Description has so far been made of an embodiment of this invention with reference to the figures. However, this invention is not limited thereto. For example, although in the above-mentioned embodiment the collective flame-hole portions 32 were made into rhombus in shape, the shape may be square or triangle which is other than rhombus. Further, the diameter of the outside flame holes 3*b*' may be different from that of the flame holes 3*b* in the collective flame-hole portions 32.

EXPLANATION OF REFERENCE MARKS

3 . . . combustion plate
3*a* . . . plate main body
3*b* . . . flame hole
3*b*' . . . outside flame hole
31 . . . non-flame-hole portion
32 . . . collective flame-hole portion
P . . . center distance (or spacing), in the longitudinal direction of the non-flame-hole portion, between the flame holes to be formed in the collective flame-hole portion
P' . . . center distance (or spacing), in the longitudinal direction of the non-flame-hole portion, between the outer flame holes
T . . . isosceles triangle

What is claimed is:

1. A combustion plate for use in a totally aerated combustion burner in which a ceramic plate body has formed therein a multiplicity of flame holes for ejecting a premixed gas, wherein the plate body is provided, in a lattice shape, with non-flame-hole portions having no flame holes therein, each of such regions of the plate body as are enclosed by the non-flame-hole portions constituting a collective flame-hole portion having formed therein a plurality of flame holes, along each of such sides of the non-flame-hole portions as are adjacent to each of the collective flame-hole portions, flame holes are formed at a predetermined spacing therebetween in a longitudinal direction of the non-flame-hole portions, the predetermined spacing being set to be greater than a spacing, in the longitudinal direction of the non-flame-hole portions, between adjoining flame holes formed in the collective flame-hole portions and, setting is made to meet a condition $P' \geq 2P$, where P is a center distance, in a direction parallel to the longitudinal direction of the non-flame-hole portions, of flame holes formed in the collective flame-hole portions and where P' is a center distance, in the longitudinal direction of the non-flame-hole portions, of flame holes formed along each of the sides of the non-flame-hole portions.

2. The combustion plate as set forth in claim 1, wherein, provided that the flame holes formed along each of the sides of the non-frame-hole portions are defined as outside flame holes, outside flame holes along one width side of the non-flame-hole portions and outside flame holes along the other width side thereof are disposed at a positional shifting from each other in the longitudinal direction of the non-flame-hole portions.

3. The combustion plate as set forth in claim 2, wherein at a top of an isosceles triangle having a base formed by a line connecting the centers of adjoining two outside flame holes along each of the width sides of the non-flame-hole portions, there is positioned a center of an outside flame hole along the other width side of the non-flame-hole portions.

* * * * *